United States Patent [19]

Talacko

[11] Patent Number: 4,706,890

[45] Date of Patent: Nov. 17, 1987

[54] METHOD AND APPARATUS FOR ELECTROSTATIC COATING OF ARTICLES WITH POWDERED COATING MATERIAL

[75] Inventor: Radovan Talacko, St. Gall, Switzerland

[73] Assignee: Ransburg-Gema AG, Switzerland

[21] Appl. No.: 852,149

[22] Filed: Apr. 15, 1986

[30] Foreign Application Priority Data

Apr. 22, 1985 [DE] Fed. Rep. of Germany ..... 3514523

[51] Int. Cl.[4] ..... B05B 5/00; B05B 7/08; B05B 1/26; H05F 3/00

[52] U.S. Cl. ..... 239/692; 239/705; 239/426; 239/524; 361/227

[58] Field of Search ..... 239/3, 8, 690–692, 239/704–707, 426, 524; 361/227

[56] References Cited

U.S. PATENT DOCUMENTS

| | | | |
|---|---|---|---|
| 3,802,625 | 4/1974 | Buser et al. | 239/704 |
| 3,903,321 | 9/1975 | Schaad | 427/25 |
| 4,004,733 | 1/1977 | Law | 239/3 |
| 4,090,666 | 5/1978 | Peck | 239/15 |
| 4,316,582 | 2/1982 | Kobayashi et al. | 239/692 |
| 4,399,945 | 8/1983 | Ruud | 239/697 |
| 4,659,019 | 4/1987 | Talacko | 239/692 |

FOREIGN PATENT DOCUMENTS

| | | |
|---|---|---|
| 2347491 | 10/1972 | Fed. Rep. of Germany . |
| 134841 | 3/1901 | German Democratic Rep. . |

*Primary Examiner*—Andres Kashnikow
*Assistant Examiner*—Patrick N. Burkhart
*Attorney, Agent, or Firm*—Ostrolenk, Faber, Gerb & Soffen

[57] ABSTRACT

A spraying gun for electrostatic spraying of coating material on an article contains a discharge electrode which is disposed entirely outside the region where the coating material flows. The coating material is accelerated through an annularly shaped and axially extending channel in which the coating material is electrically charged by friction between itself and the insulated walls that define the channel. A gas conduit extends from the discharge electrode and reaches into the annular feed channel of the coating material. Location of the gas conduit between the discharge electrode and the feed channel allows the gas flowing in the gas conduit toward the feed channel to serve the dual purposes of preventing coating material from flowing to and settling on the discharge electrode and providing an electrically conductive path through which undesired electrical charges which develop on the walls of the feed channel discharge to the discharge electrode.

8 Claims, 2 Drawing Figures

METHOD AND APPARATUS FOR ELECTROSTATIC COATING OF ARTICLES WITH POWDERED COATING MATERIAL

BACKGROUND OF THE INVENTION

The present invention relates to a method and apparatus for electrostatically coating articles with powdered coating material.

In accordance with a known concept of the present invention, coating material is constrained to flow over charging surfaces made from electrically insulating material. Friction between the coating material and the charging surfaces electrically charges the coating material which then becomes suitable for coating. Disadvantageously, however, undesired electrical charges collect at the charging surfaces and these must be removed by discharging the surfaces. Conventionally, one or more discharge electrodes are suitably arranged for conducting the undesired charges away from the charging surfaces. Also, as part of the process, a gas accelerant is directed along the discharge electrode and into the stream of the electrically charged coating material. Thereafter, the gas diffused and electrically charged coating material is sprayed through a nozzle.

A method and apparatus relating to the present subject matter is disclosed Federal Republic of Germany Pat. No. 23 47 491. In the Pat. No. 23 47 491, the discharge electrode is located partially within and reaches into a region where the stream of powdered coating material is present. Consequently, to prevent coating material from settling on the discharge electrode, a strong stream of gas must blow over the discharge electrode. A strong gas stream implies a faster moving and larger quantity of gas. This unduly dilutes the coating material and causes it to travel too fast. More of the faster moving coating material particles bounce off the article to be coated. Many particles of the too diluted coating material never reach the article.

Federal Republic of Germany Pat. No. 22 03 351 discloses a coating apparatus in which the charging surface is formed by a wall which defines a feed channel for the coating material. A grounded metal sleeve surrounds the outside wall of the channel and serves as a discharge electrode. This method of discharging is, however, not as effective as the electrode described in previously mentioned German Pat. No. 23 47 491 in which the discharge electrode reaches into and contacts the inner surface of the channel over which the coating material flows.

The greater the velocity at which particles move over a charging surface, the more efficiently they are charged. To this end, U.S. Pat. No. 4,090,666 proposes that a stream of coating material be accelerated and driven radially outwardly against the wall of the feed channel by a stream of gas which axially surrounds the stream of coating material. This method, however, has the already mentioned disadvantage that the streams of coating material will be too diluted by the gas and will emerge at too high a velocity.

An apparatus of the type referred to herein which provides a larger changing surface is described in German Democratic Republic Pat. No. 134 841. It has an electrically insulating material inner body located within a similarly electrically insulated outer body, with an annular feed channel defined between the inner and outer bodies. A discharge electrode is disposed within the region of flow of the coating material. Again the problem of coating material depositing on the discharge electrode must be contended with.

Coating material or gas moving at high velocities produce extensive wear in the flow channels. Devices in which gas is not added to the coating material are advantageous in that the flow velocity of the coating material is about 50% lower than if gas is added. Gas is commonly used to blow the coating material away from the discharge electrode and/or to drive the coating material faster to achieve more efficient electrokinetic charging. The gas referred to thus far is to be distinguished from gas which is necessary in any case for pneumatically conveying coating material to the target article. Generally, however, the conveying gas poses no problem in that a relatively small quantity of such gas is sufficient for the indicated purpose as a relatively small amount of conveyor gas is sufficient to move rapidly enough so no coating material will deposit in the channels of the apparatus.

The spraying apparatus is usually in the shape of a hand-held spray gun. Such gun must be as light and as small as possible from both cost and ease of handling considerations.

SUMMARY OF THE INVENTION

It is an object of the present invention to provide an electrostatic coating apparatus in which the coating material is very efficiently electrically charged by friction.

It is a further object of the present invention to provide a coating apparatus of the above type in which the electrical charging process is not accompanied by gradual degradation of the efficiency of charging because of anti-electric charging or settling of coating material in the apparatus.

It is a further object of the present invention to provide an electrostatic spraying apparatus in which only a small quantity of gas is mixed with the coating material to achieve a low flow velocity that enhances coating efficiency, quality of coating and reduces wear in the apparatus.

The foregoing and other objects of the present invention are realized by a method and apparatus in which the discharge electrode is located outside the region where the coating material flows while still performing as if it was located within. The gas flows over the discharge electrode and into the feed channel for the coating material and serves firstly to keep the coating material away from the discharge electrode and, secondly, the gas serves as an electrical conductor through which undesired electrical charge collecting on the charging surface are conducted to the discharge electrode which is itself connected to ground or to any other predetermined electrical potential.

In a preferred embodiment, the apparatus comprises a feed channel for the coating material which has an upstream end through which the coating material is introduced and a downstream spray opening through which it is sprayed. At least one charging surface, formed of electrically insulating material, is present in the feed channel. Electrical charging is induced by frictional contact between the coating material and the charging surface. At least one discharge electrode is disposed outside the feed channel for the coating material and a gas channel is defined to extend over the discharge electrode and debouch or emerge into the feed channel. As mentioned, the gas flowing in the gas channel prevents the charged coating material from migrating to and settling on the discharge electrode. At the same time, the undesirable charges collected on the charging surface are, however, capable of flowing to the discharge electrode.

Thus, the foregoing objectives of the present invention are met in that the discharge electrode(s) are located entirely outside the stream of coating material and gas is used in a novel manner for providing an electrical conduction path through which cations or anions formed on the surface of the charging surfaces can flow to the discharge electrode. A small quantity of gas at low pressure is sufficient for the purposes of the present invention to keep the discharge electrodes clean and to provide a good electrical conduction path.

Among others, the invention provides the advantages of:

(1) low energy consumption, due to low quantity of gas delivered at low pressure;
(2) little or no wear of the channels which carry the gas and the coating material;
(3) very minor effect by the gas on the coating material from coating material dilution and velocity perspectives;
(4) good coating quality due in part to slow, uniform speed of emergence of the coating material from the spray nozzle of the apparatus;
(5) more efficient coating due to the low flow velocity of the coating material which will result in less coating particles bouncing off the article or being lost before reaching the article;
(6) the spraying apparatus may be structurally shorter in that more efficient charging of the coating material is obtained over a shorter path; and furthermore a short deceleration path is necessary for slowing down the otherwise accelerated coating material; and
(7) the flow velocity of the coating material in the apparatus of the present invention need only be high enough to assure that it will not be deposited within the apparatus. This will allow the coating material to flow at a velocity which is comparable to that found in an apparatus of the type which does not use additional gas.

Other features and advantages of the present invention will become apparent from the following description of preferred embodiments of the invention which are described below in relation to the accompanying drawings.

DETAILED DESCRIPTION OF THE PREFERRED EMBODIMENTS

Figures 1, 2:
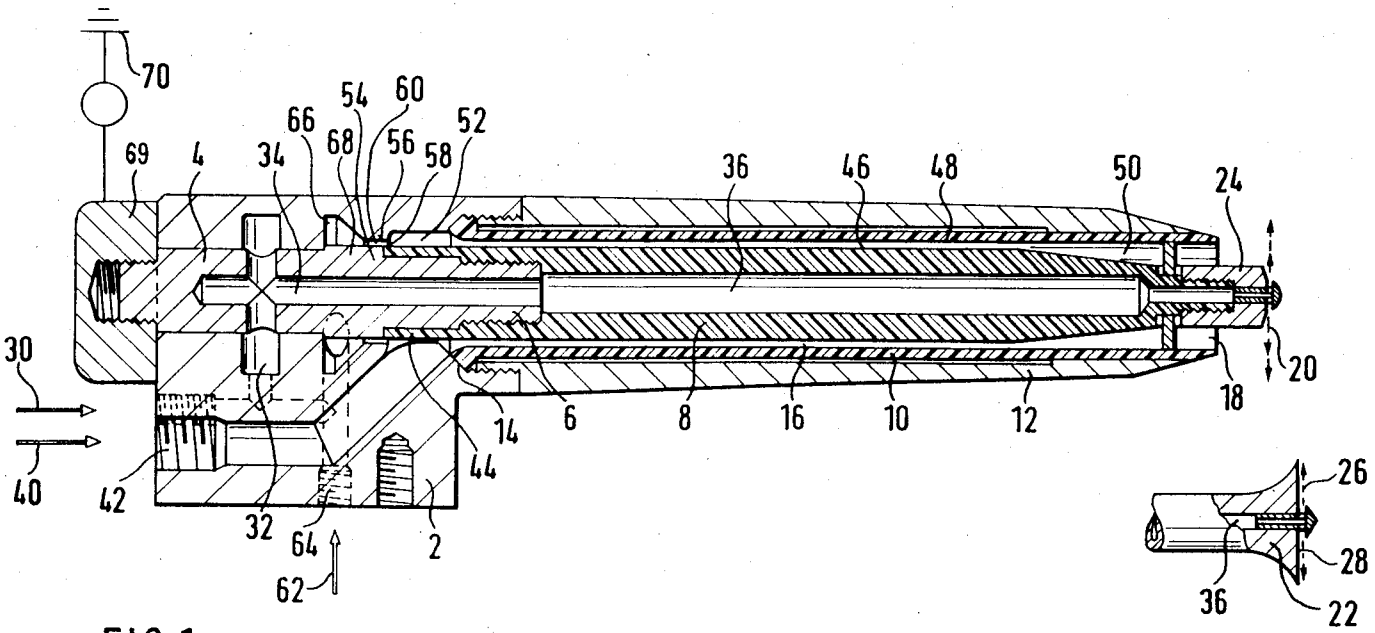
FIG. 1 is a diagrammatic, longitudinal section through an apparatus in accordance with the present invention.
FIG. 2 illustrates a second embodiment showing the downstream spraying end of the spraying device of the present invention.

Referring to FIG. 1, the apparatus of the present invention comprises a base member 2 and a discharge electrode 4 of electrically conducting material which extends through base member 2. An inner member 8 of electrically insulating material screws onto one end 6 of discharge electrode 4. An outer member 10 also made of electrically insulating material is spaced radially from and coaxially surrounds inner member 8. A protective sleeve 12 surrounds outer member 10 and is screwed into base member 2 in a manner that it clamps the upstream end 14 of outer member 10 between itself and base member 2.

Inner member 8 and outer member 10 can be comprised of the base of different materials as long as electrically insulated materials are used. Members 8 and 10 form between them an annularly shaped feed channel 16, the downstream end 18 of which forms a spray opening. Powdered coating material traveling axially through feed channel 16 emerges from the spray opening and is deflected at that point either by a pneumatic baffle member 20, as shown in FIG. 1, or by a mechanical baffle member 22, as seen in FIG. 2. Either baffle member 20 or 22 forms the coating material into a spray cloud.

Pneumatic baffle member 20 consists of a gas curtain which emerges substantially radially from end 24 of inner member 8. The alternate, mechanical baffle member 22 of FIG. 2, is also located at the downstream end 24 of inner member 8. It is shaped to create a gas curtain 26 which emerges from the center of mechanical baffle member 22 and spreads radially, as shown. Gas curtain 26 serves primarily to keep the downstream end surface 28 of mechanical baffle member 22, clean. However, gas curtain 26 can be sufficiently powerful to extend radially beyond mechanical baffle member 22 to serve as a pneumatic baffle in the more outwardly extending region.

Gas 30 for creating gas curtain 20 or 26 flows to the downstream end of inner member 8 via gas-channel section 32 defined in base member 2 and from there through gas-channel section 34 formed in the discharge electrode 4 and hollow space 36 in inner member 8 to the baffle member 20 of FIG. 1 on the baffle member 22 of FIG. 2. Hollow space 36 is in the shape of a bore which extends axially through inner member 8.

Coating material 40, in powder form, is injected through channel 42, formed in base member 2 between upstream end 14 of outer member 10 and end 44 of inner member 8 which end 44 protrudes axially beyond outer member 10. From channel 42, coating material 40 flows into the annularly shaped feed channel 16 defined between inner and outer members 8 and 10 and from there it emerges at spray opening 18. The effective crosssectional area of feed channel 16 is smaller than that of channel 42 so that the coating material is accelerated in feed channel 16. Moreover, the shape of feed channel 16 causes all particles of the coating materials to come into contact at least once with one of charging surfaces 46 and 48. Charging surface 46 and charging surface 48 are defined, respectively, by the outer surface of inner member 8 and the inner surface of outer member 10. In contacting the charging surfaces the coating material becomes electrically charged by friction.

Inner member 8 and outer member 10 can also be comprised of electrically conductive material as long as their charging surfaces 46 and 48 are formed of electrically insulating material. Inner member 8 tapers down conically at its downstream end 24 in contrast to charging surface 48 whose cross-sectional dimensions remain constant throughout. Thus, a feed-channel section 50 is defined near spray opening 18 having an increasing cross-section which slows the coating material.

The electrically insulated upstream section 44 of inner member 8 separates discharge electrode 4 from feed channel 16 and channel 42 of base member 2. Channel 42, through which the coating material is injected, communicates into an upstream initial section 52 of feed channel 16. Starting section 52 is bounded between upstream end-section 44 of inner member 8 and base member 2. The most upstream point 14 of outer member 10 is axially shifted downstream from starting section 44 of inner member 8. This arrangement allows channel 42 to debouch or emerge into feed channel 16 more easily. Further, the arrangement creates the annular gas channel 60 which is defined between section 54 of discharge electrode 4 and section 56 of base member 2. Annular gas channel 60 debouches or communicates into initial section 52 at the downstream end thereof. The interface point 58 between gas channel 60 and initial section 52 is located approximately at the termination point of upstream section 44 of inner member 8.

Section 44 of inner member 8 consists of electrically insulating material extending beyond point 58 upstream of gas channel 60 so as to assure that coating material 40 flowing through feed channel section 52 is kept away from discharge electrode 4.

Gas 62 flows via bore 64 in base member 2 into annular space 66 wherein it flows around a section 68 of discharge electrode 4. From there, gas 62 passes into the narrower gas channel 60 where it is strongly accelerated. From there, gas 62 flowing as an annular column penetrates into upstream initial section 52. Due to its high velocity, a small quantity of gas 62 is sufficient to prevent coating material from traveling backward from initial section 52 into gas channel 60. All that is necessary is for the pressure of gas 62 in gas channel 60 to be slightly higher than the pressure of coating material 40 at the point of emergence 58.

Furthermore, in addition to maintaining discharge electrode free of coating material, a gas cushion is formed at point 58 which keeps the coating material away.

In addition, gas 62 in gas channel 60 provides a conductive path for electrical charges, namely cations or anions. Whether cations or anions are produced depends on the type of material of which charging surfaces 46 and 48 are made. The underside electrical charges flow through gas 62 to discharge electrode 4 in a direction against the flow. Discharge electrode 4 conducts these charges to ground potential 70 via a screwed on nut 69. If desired, the electrical charge could be conducted to some other electrical potential which is not necessarily at ground level.

Although the present invention has been described in relation to preferred embodiments thereof, many other variations and modifications will now become apparent to those skilled in the art. It is preferred, therefore, that the present invention be limited not by the specific disclosure herein, but only by the appended claims.

What is claimed is:

1. An apparatus for electrostatic spraying of coating material on articles, the apparatus comprising:

a feed channel having a first end through which the coating material is introduced into the feed channel and a second end through which the coating material emerges, the feed channel having at least one charging surface therein made of electrically insulated material suitable for electrically charging the coating material by friction;

at least one discharge electrode disposed at a location outside of the feed channel, the at least one discharge electrode including means for connection thereof to a predetermined electrical potential;

a gas channel extending between the at least one discharge electrode and the feed channel, the gas channel being suitable for enabling an electrically conductive gas to flow and contact both the at least one discharge electrode and the at least one charging surface in the feed channel, whereby the gas is effective for preventing coating material from reaching the at least one discharge electrode and also for providing an electrically conductive path through which electrical charges collected on the at least one charging surfaces are conducted to the at least one discharge electrode.

2. An apparatus according to claim 1, wherein the gas channel comprises a first gas channel section located nearer the at least one discharge electrode and a second gas channel section having a reduced gas passage cross-section located adjacent the feed channel, the second gas channel section being effective for accelerating the gas prior to its entry into the feed channel.

3. An apparatus according to claim 1, wherein the gas channel is disposed annularly around the at least one discharge electrode.

4. An apparatus according to claim 1, which comprises an axially extending inner member having a circular cross-section and a cylindrically shaped outer surface, an outer member surrounding and radially spaced from the inner member to define an annularly shaped clearance which comprises the feed channel, the outer member having an inner surface which faces the outer surface of the inner member, the inner surface of the outer member and the exterior surface of the inner member being comprised of the electrically insulative material and forming the at least one charging surface of the apparatus.

5. An apparatus according to claim 4, in which the at least one discharge electrode is disposed axially in line with the inner and outer members, both the at least one discharge electrode and the inner member comprising a respective axially extending gas conveying channel, the respective gas conveying channel in the inner member and in the at least one discharge electrode being in communication with one another.

6. An apparatus according to claim 4, in which the inner member is mounted to the at least one discharge electrode, the inner member having an initial section which protrudes axially beyond an upstream end of the feed channel through which the coating material is introduced into the feed channel, the outer member of the feed channel comprising an upstream end which is axially offset from the axially protruding section of the inner member.

7. An apparatus according to claim 1, wherein the feed channel comprises a widened crosssectional area adjacent the downstream end of the feed channel, the widened cross-sectional area being suitable for decelerating the coating material as it flows therethrough.

8. An apparatus according to claim 7, wherein the widened cross-sectional area is formed by a conically tapering section of the inner member.

* * * * *